United States Patent [19]

Moll

[11] Patent Number: 4,650,454

[45] Date of Patent: Mar. 17, 1987

[54] ROLLER FOR GLUE APPLYING FOLDING MACHINES

[76] Inventor: Richard J. Moll, c/o Dick Moll & Sons, 415 Constance Dr., Warminster, Pa. 18974

[21] Appl. No.: 703,726

[22] Filed: Feb. 21, 1985

[51] Int. Cl.[4] ..... B31F 1/10

[52] U.S. Cl. ..... 493/442; 29/121.1; 29/125; 29/130; 118/221; 156/204; 493/420

[58] Field of Search ..... 493/419–421, 493/424, 442, 443, 454, 471; 29/119, 121.1, 124, 125, 129, 130; 403/362; 156/204; 118/221, 226

[56] References Cited

U.S. PATENT DOCUMENTS

| | | | |
|---|---|---|---|
| 1,547,214 | 7/1925 | Gooding | 403/362 |
| 1,889,527 | 11/1932 | Barber | 29/129 |
| 1,924,472 | 8/1933 | Thomson | 156/204 |
| 2,629,616 | 2/1953 | McVey | 403/362 |
| 3,616,069 | 10/1971 | Schwalbach | 493/442 |
| 3,708,243 | 1/1973 | Wooden | 403/362 |
| 3,727,576 | 4/1973 | Schriber | 118/221 |
| 3,796,423 | 3/1974 | Shuster | 493/421 |
| 3,897,943 | 8/1975 | Head et al. | 493/443 |
| 3,964,658 | 6/1976 | Edwards | 29/125 |
| 4,375,971 | 3/1983 | Moll | 493/442 |

*Primary Examiner*—Frederick R. Schmidt
*Assistant Examiner*—Robert Showalter
*Attorney, Agent, or Firm*—Z. T. Wobensmith, III

[57] ABSTRACT

A roller for glue applying folding machines is disclosed which grips paper sheets to be advanced for folding, and which sheets have had one or more lines of glue applied thereto, which roller includes a plurality of spaceable segmented roller elements, detachably secured to a metal shaft, which elements have a resilient outer layer bonded thereto with an end to end helical groove, providing for advancing the paper sheets, and which grooves expel debris picked up from the surfaces of the advanced paper sheets.

2 Claims, 12 Drawing Figures

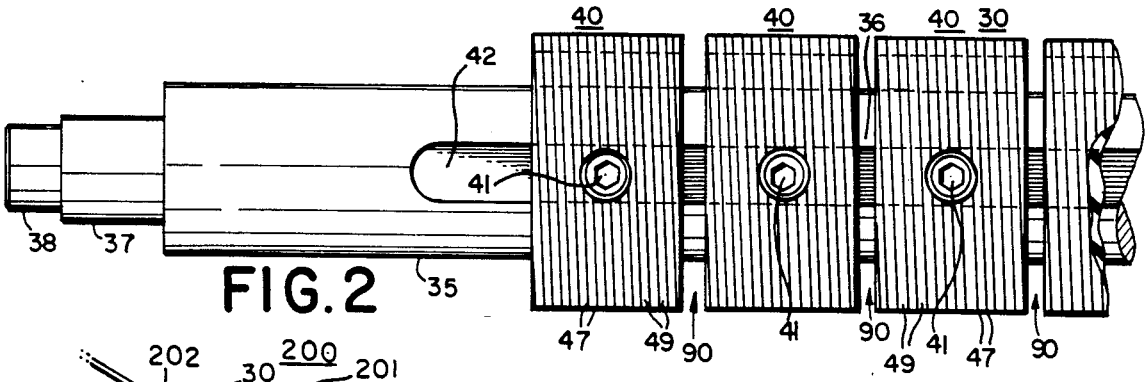
FIG. 2
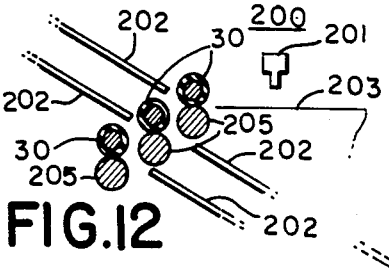
FIG. 12
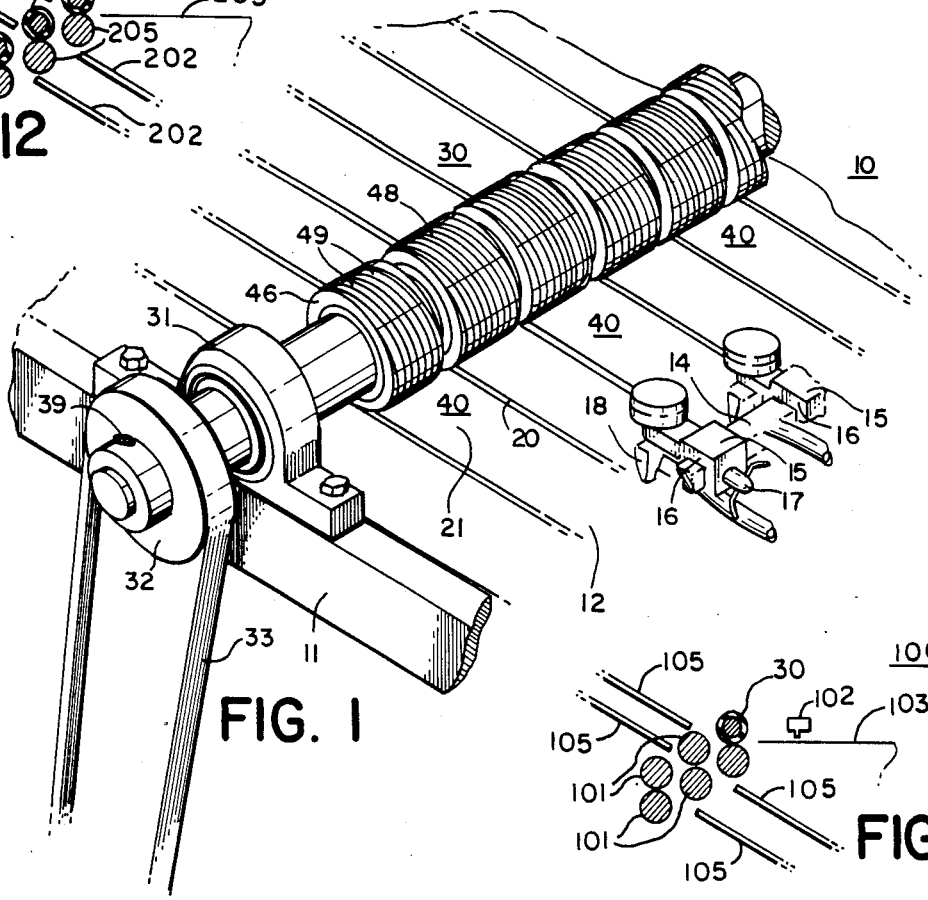
FIG. 1
FIG. 11
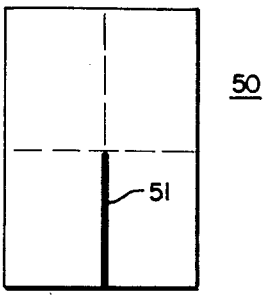
FIG. 3
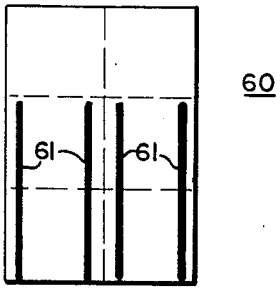
FIG. 4
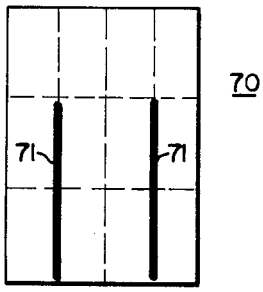
FIG. 5

ROLLER FOR GLUE APPLYING FOLDING MACHINES

BACKGROUND OF THE INVENTION

1. Field of the Invention

This invention relates to rollers for advancing paper sheets into paper folding machines, and more particularly to a roller for use with glue applying paper folding machines, which roller includes a plurality of detachable, spaceable segmented roller elements, carried on a metal shaft.

2. Description of the Prior Art

In certain paper folding machine operations, it is necessary and desirable to be able to apply lines of glue to the paper sheets to be folded so that they may be bound in the folding machine. Examples of such products obtained by using paper with glue lines thereon would be double lottery tickets, wallets, and multiple page documents. It is important that none of the glue which is laid down on the paper sheets prior to folding, actually get on the roller surfaces, as the paper sheets would then stick to the roller and the glue would interfere with the machine's operation.

The common practice in the folding machine industry when it is desired to lay down glue lines on paper sheets, is to groove the roller or set of rollers which pick up the paper at the glue locations. With this approach, every time the location of the glue lines are changed it is necessary to groove the roller or to install another roller, all of which is awkward, expensive, and time consuming.

various rollers have been used in folding machines for paper advancement, such as those disclosed in the U.S. Pat. No. 3,796,423, to Shuster and U.S. Pat. No. 4,375,971, to Moll which while suitable for paper advancement, would not be useful for advancing paper sheets with glue lines without drastic modifications which could defeat their intended purpose, and/or result in the problems described above.

The roller of the invention provides a self-cleaning gripping surface with easy placement and replacement of the roller elements, to accommodate different numbers and spacings of gluing lines.

SUMMARY OF THE INVENTION

In accordance with the invention a roller for glue applying folding machines, is disclosed, which includes a plurality of separable segmented roller elements for gripping and advancing paper sheets to a folding machine for folding, which elements are detachably secured to a metal shaft and capable of being in spaced or meeting relation, and have resilient outer gripping layers with end to end sets of helical grooves thereon.

The principal object of the invention is to provide a roller for glue applying paper folding machines which is capable of use with a plurality of different arrangements of glue applying folding machines.

A further object of the invention is to provide a roller of the character aforesaid wherein the roller elements are easily placed and replaced on the roller shaft to accommodate varying placements of glue lines.

A further object of the invention is to provide a roller of the character aforesaid which is easy to clean.

A further object of the invention is to provide a roller of the character aforesaid which is durable and long lasting in service.

A further object of the invention is to provide a roller of the character aforesaid which can be easily manufactured.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which:

FIG. 1 is a fragmentary perspective view illustrating one embodiment of the roller of the invention in place in a typical paper folding machine;

FIG. 2 is a fragmentary side elevational view of the roller of the invention;

FIG. 3 is a top view of a sheet of paper with a single glue line thereon;

FIG. 4 is a top view of a sheet of paper with four parallel glue lines thereon;

FIG. 5 is a top view of a sheet of paper with two parallel glue lines thereon;

FIG. 11 is a diagrammatic view of a folding machine using one of the rollers of the invention; and FIG. 12 is a view similar to FIG. 11 but illustrating a folding machine which uses three rollers of the invention.

Figure 6:
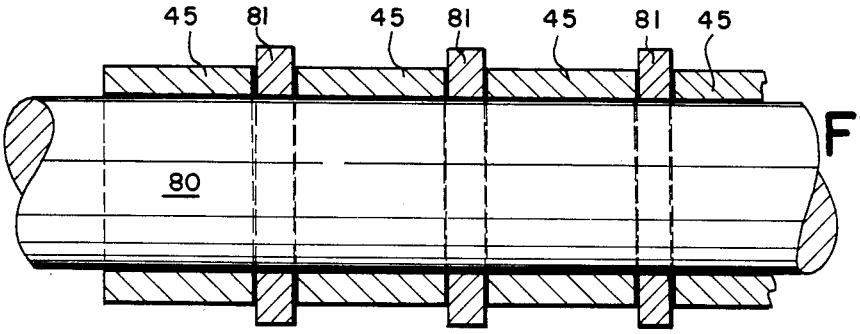
FIG. 6 is a vertical sectional view in partial phantom showing the first stage of manufacturing the roller elements of the roller of the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings and FIGS. 1 to 5, a portion of a typical paper folding machine 10 is illustrated in FIG. 1 in fragmentary form. The machine 10 includes a side frame rail 11, a moving conveyor belt 12, and a transversely extending glue head mounting bar 14, which has a plurality of glue heads 15 mounted thereon, which are capable of transverse movement along the bar 14.

The glue heads 15 are of conventional type, each of which has a mounting block 16 which engages the bar 14, a thumbscrew 17 engaged with the block 16 and bar 14, for retaining the heads 15 at the desired locations, and a nozzle 18 for dispensing or laying down glue lines 20, on sheets of paper 21.

A roller 30 is shown carried in a bearing block 31, which is mounted to the side frame rail 11 and may be mounted at its opposite end in the same manner (not shown). The roller has a pulley 32 mounted thereto, which has a belt 33 engaged therewith, which extends to a driving motor (not shown). The roller 30, as illustrated, includes a shaft 35, preferably of metal, with center section 36 and reduced diameter journal 37 for rotation in the bearing block 31, and which has a further reduced diameter portion 38 to which the pulley 32 is secured by set screw 39. The roller 30 has a plurality of roller elements 40 mounted to the shaft 35 by set screws 41 which engage a flat 42, on the center section 36 of shaft 35 to prevent rotation and sidewise movement.

The roller elements 40 each include a collar 45, which fits over the center section 36 of shaft 35 and which is preferably formed of aluminum but which can be formed of other materials as desired. The collar 45 each has a layer or covering 46 thereon preferably of urethane which is capable of being vulcanized and machinable. The urethane after vulcanization has a durometer reading in the range from 60 to 70, and is preferably 65. The covering 46 is of a thickness of approximately one eighth of an inch and after vulcanization has helical grooves 47 cut therein so that ribs 48 formed thereby have flat outer faces 49, separated by the helical grooves 47 which extend from one end to the other.

The flat outer faces 49 preferably have a width of about that of the grooves 47 or may be slightly smaller. For a roller diameter of one and one half to one and three quarter inches, the grooves 47 can be spaced the order of 16 per inch and of a depth of about thirty thousandths of an inch which have been found satisfactory in use.

The covering 46 can easily be replaced when unserviceable thereby maintaining the cost of operation at a low level.

The flat faces 49 separated by the grooves 47 which run helically end to end on the roller element 40, flex because of their resiliency, and thereby act to expel any debris that may be picked up by the covering 46 and also grip the sheets of paper to advance them for folding.

FIG. 3 illustrates a sheet of paper 50 which has had a single line of glue 51 laid thereon by two glue heads 15, and which may be folded and joined to provide an 8, 12, or 16 page signature.

FIG. 4 illustrates a sheet of paper 60 which has had four parallel lines of glue 61 laid thereon, by four glue heads 15, and which may be folded and joined to provide an 8, 12, or 16 page signature.

FIG. 5 illustrates a sheet of paper 70 which has had two parallel lines of glue 71 laid thereon, by two glue heads 15, and which may be folded and joined to provide a double lottery ticket.

Referring now more particularly to FIGS. 6 to 10 inclusive, a preferred method of manufacturing the roller elements 40 is illustrated. In FIG. 6 a shaft 80 is shown on which a plurality of collars 45 have been placed, with spacers 81 therebetween, and which have a diameter approximately equal to the finished diameter of a roller element 40.

Figure 7:
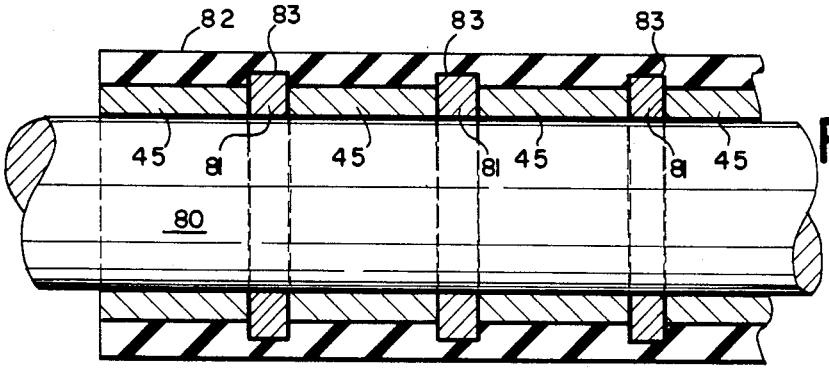
FIG. 7 is a view similar to FIG. 6 showing the second stage of manufacturing the roller elements.
Figure 8:
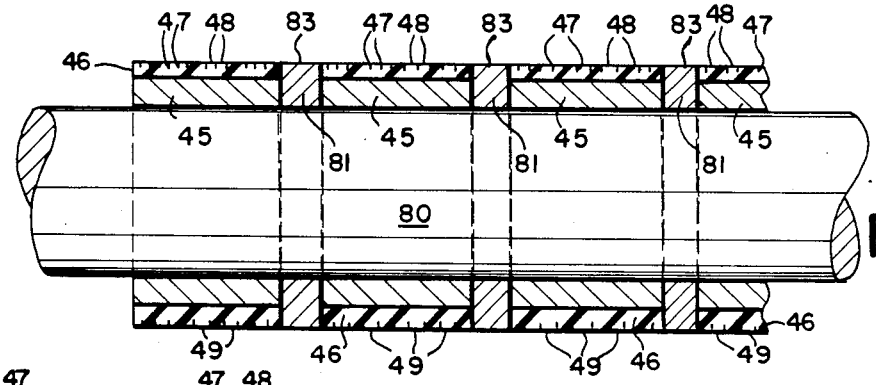
FIG. 8 is a view similar to FIG. 6 showing the third stage of manufacturing the roller elements.

The roller elements 40 and spacers 81 are coated with a covering or layer 82 of urethane providing a structure as shown in FIG. 7 which is then vulcanized. The outside diameter of the layer 82 is reduced or ground to achieve a smooth finish, until the outside surface 83 of the spacers 81 is exposed, to provide the resultant structure as shown in FIG. 8.

Figure 9:
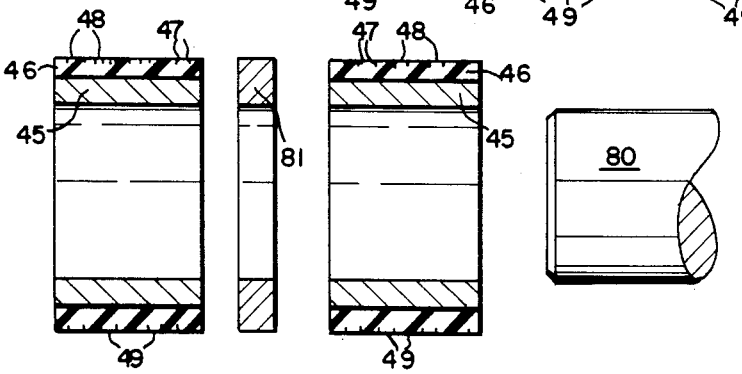
FIG. 9 is an exploded sectional view showing roller elements of FIG. 8 being removed from the structure of FIG. 8 for further manufacturing operations.

The roller elements 40 and spacers 81 are removed from shaft 80 as shown in FIG. 9. The roller elements as shown in FIG. 10 are drilled and tapped to provide a threaded hole 85 and a set screw 41 of conventional type is installed therein.

Figure 10:
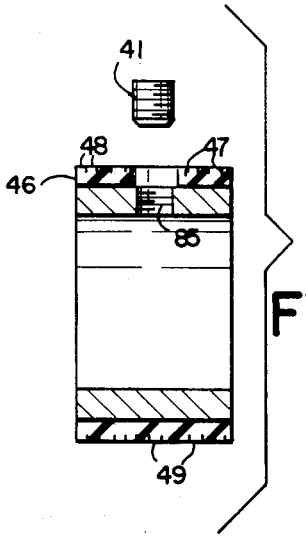
FIG. 10 is a vertical sectional view of a complete roller element ready for installation and use.

The roller elements 40 of FIG. 10 are then assembled onto a shaft 35 in meeting relation (not shown), the set screws 41 are tightened and the helical grooves 47 cut therein across the entire assembled length of elements 40, to provide ribs 48 and alternating flat outer faces 49 as described above.

The roller elements 40 can then be placed on another shaft 35 and separated as required to provide spaces 90 therebetween, as shown in FIGS. 1 and 2, and installed in a folding machine 10.

Referring now more particulary to FIG. 11, a diagrammatic view of a folding machine 100 is illustrated, which includes one fold roller 30 of the invention, which is the first and top roller of the series of rollers 101, which are of conventional type. A glue head 102 is disclosed as well as a feed belt 103. A plurality of fold plates 105 are provided and, in this arrangement, an eight page signature can be produced which uses the first fold plate 105 to make the first fold and the subsequent sets of rollers and plates to make the remaining folds.

Referring now to FIG. 12, a diagrammatic view of a folding machine 200 is shown, which includes glue heads 201, fold plates 202, feed belt 203, three fold rollers 30 of the invention, along with opposed rollers 205 of conventional type. In this arrangement a twelve page signature can be obtained by the use of the three top mounted fold rollers 30 of the invention.

It should be noted that the elements 40 can be placed on the shaft 35 end to end, or separated to provide for as many or as few glue lines as are desired, and consistent with the capabilities of the folding machine on which the roller is used. The spaces 90 are located at the glue lines 20 so that no glue gets on the roller elements 40, and so that the sheets of paper are advanced for folding as required. Removal and/or relocation of the roller elements 40 merely requires loosening and tightening of the set screw 41 and their placement along the shaft 35.

It will thus be seen that a roller has been provided with which the objects of the invention are achieved.

I claim:

1. In a paper folding machine which uses rollers that are fixedly and transversely mounted between bearing blocks, which rollers advance the paper to be folded, and wherein apparatus is provided for dispensing at least one glue line onto a sheet of paper prior to folding, said apparatus including a transversely mounted adjustable glue head, and wherein at least one of the rollers comprises a shaft mounted in said bearing blocks, a plurality of roller elements detachable mounted to said shaft in fixed non-rotational relation, each of said roller elements having individual transverse adjustment means cooperating with said shaft to provide unlimited transverse adjustments while said shaft is in said machine, in which at least one of said roller elements is spaced from the other roller elements to provide a space therebetween so that a sheet of paper with a least one glue line thereon may be gripped and advanced by said roller, said roller elements each including a collar, a resilient covering of urethane secured to said collar and having a durometer in the range from 60 to 70, and said covering having a plurality of helical grooves thereon separating a plurality of flat faces.

2. A roller as defined in claim 1 in which said shaft has a flat portion thereon, and said roller elements each have set screws for engagement with said flat portion to retain said elements from rotational or transverse movement thereon.

* * * * *